US007891031B2

(12) United States Patent
Khalaf et al.

(10) Patent No.: US 7,891,031 B2
(45) Date of Patent: Feb. 22, 2011

(54) MOVABLE DECK

(76) Inventors: Belal Fathi Khalaf, 22 Remah Street, King Fahd District, Riyadh (SA); Mazin Mohammad Khrais, Murjan St Block 3665, AL Mansour Compound villa 103, Sulaymaneyyah District, Riyadh (SA)

( * ) Notice: Subject to any disclaimer, the term of this patent is extended or adjusted under 35 U.S.C. 154(b) by 1251 days.

(21) Appl. No.: 11/458,821

(22) Filed: Jul. 20, 2006

(65) Prior Publication Data

US 2008/0016611 A1 Jan. 24, 2008

(51) Int. Cl.
*E04H 4/00* (2006.01)

(52) U.S. Cl. ..... 4/498

(58) Field of Classification Search ..... 4/498, 4/500, 503; 52/64–68
See application file for complete search history.

(56) References Cited

U.S. PATENT DOCUMENTS

| | | | | |
|---|---|---|---|---|
| 2,737,919 | A | 3/1956 | McRae | |
| 2,788,849 | A | 4/1957 | Lingard | |
| 2,848,722 | A | 8/1958 | Choporis | |
| 2,990,556 | A | 7/1961 | Bender | |
| 3,091,777 | A | 6/1963 | Pearlson | |
| 3,093,834 | A | 6/1963 | Watkins | |
| 3,114,153 | A | 12/1963 | Pierson | |
| 3,118,148 | A | 1/1964 | Taylor et al. | |
| 3,679,177 | A * | 7/1972 | Scholz | 254/89 R |
| 4,711,257 | A * | 12/1987 | Kobayashi | 134/56 R |
| 7,412,733 | B2 * | 8/2008 | Dorsch | 4/498 |
| 2002/0000069 | A1 * | 1/2002 | McNamara | 52/66 |
| 2008/0263759 | A1 * | 10/2008 | Chapus | 4/498 |

OTHER PUBLICATIONS

Dripool, webpage www.dripool.co.uk/automatic_covers.html, dated Sep. 27, 2005, one page.

* cited by examiner

*Primary Examiner*—Huyen Le
(74) *Attorney, Agent, or Firm*—Gavrilovich, Dodd & Lindsey LLP

(57) ABSTRACT

A deck construction includes a movable, rigid, unitary platform with wheels mounted to its bottom and supporting tracks arranged on opposite sides of an open space below the platform. The wheels roll along the tracks, allowing horizontal movement of the platform. At least one drive mechanism is mounted on a side of the open space to engage a rack on the platform. One or more stationary sources of rotary power, such as electric motors, operate the drive mechanism to cause the platform to move horizontally in either direction along the tracks. The deck construction is particularly useful as a swimming pool cover or an extensible balcony or canopy.

20 Claims, 7 Drawing Sheets

MOVABLE DECK

TECHNICAL FIELD

The present invention relates generally to movable floor structures, and more specifically, to a deck construction that includes a rigid, horizontally-movable platform that can provide additional usable floor space when extended over an open space. The movable platform is particularly suitable for use as a pool cover or extensible balcony or canopy.

BACKGROUND

Efficient utilization of inhabitant spaces in urban areas is a necessity in many situations, due primarily to a scarcity of available living space. Thus, in such settings it is desirable to have architectural structures that maximize the amount of usable living space. It is also desirable that such structures provide a high degree of safety to their inhabitants and users, as well as pleasing ascetics.

In many buildings and residences, swimming pools and balconies are attractive features. Swimming pools, however, generally require a sacrifice of space because the space occupied by a pool can not normally be used for any other purpose. This consideration reduces the desirability of swimming pools in some environments, and it may even eliminate the possibility of installing swimming pools in others.

To increase the usefulness of swimming pool space, movable swimming pool covers that double as patios or decks have been proposed. This type of pool cover not only increases useable living space, but it can also increase pool safety and keep unwanted debris such as leaves and dust out of the pool when it is not in use. U.S. Pat. No. 2,848,722 to Choporis discloses an example of such a pool cover. Although Choporis' pool cover may be useful in some settings, this early attempt at a dual-purpose pool cover presents safety issues that would likely not be acceptable under contemporary building codes in that its operation places live electrical components (e.g., wire 49) directly over and in close proximity to swimming pool water (See Choporis, FIG. 4).

In view of the foregoing, there is a need for a deck construction, having improved ascetic value and safety, that can be used as either a pool cover or extensible balcony or canopy to increase useable living space in residential settings.

SUMMARY

It is an advantage of the present invention to provide an improved movable deck construction to satisfy an increasing demand in modem residential lots for additional space utilization over swimming pools and with balconies. When used for swimming pools, this novel deck structure provides security and safety against tragic accidents related to open swimming pools, such as child drownings. In addition, when used as an extendible balcony or canopy, the inventive deck structure provides the ability to enhance building scenery.

In accordance with an exemplary embodiment of the invention, as described infra, a deck construction includes a movable, rigid platform with wheels mounted to its bottom and supporting tracks arranged on opposite sides of an open space below the platform. The structural platform spans between the two opposite sides to structural support members such as the sides of a swimming pool or spans between drop beams for supporting a balcony. The wheels roll along the tracks, allowing horizontal movement of the platform. At least one drive mechanism is mounted on a side of the open space to engage a rack on the side of the platform. At least one stationary source of rotary power, such as an electric motor, operates the drive mechanism to cause the platform to move horizontally in either direction along the tracks. Thus, the deck can be used to selectively cover open spaces such as swimming pools, or extend balconies, canopies and the like.

In this manner, the deck construction allows utilization of the super surface of pools and balconies to provide additional living, recreational and building spaces. Once a swimming pool is covered by the deck, the pool surface can be used for sporting, dining, partying, meetings or the like.

Other aspects, features, embodiments, processes and advantages of the invention will be or will become apparent to one with skill in the art upon examination of the following figures and detailed description. It is intended that all such additional features, embodiments, processes and advantages be included within this description, be within the scope of the invention, and be protected by the accompanying claims.

BRIEF DESCRIPTION OF THE DRAWINGS

It is to be understood that the drawings are solely for purpose of illustration and do not define the limits of the invention. Furthermore, the components in the figures are not necessarily to scale, emphasis instead being placed upon illustrating the principles of the invention. In the figures, like reference numerals designate corresponding parts throughout the different views.

DETAILED DESCRIPTION

The following detailed description, which references to and incorporates the drawings, describes and illustrates one or more specific embodiments of the invention. These embodiments, offered not to limit but only to exemplify and teach the invention, are shown and described in sufficient detail to enable those skilled in the art to practice the invention. Thus, where appropriate to avoid obscuring the invention, the description may omit certain information known to those of skill in the art.

Figure 1:
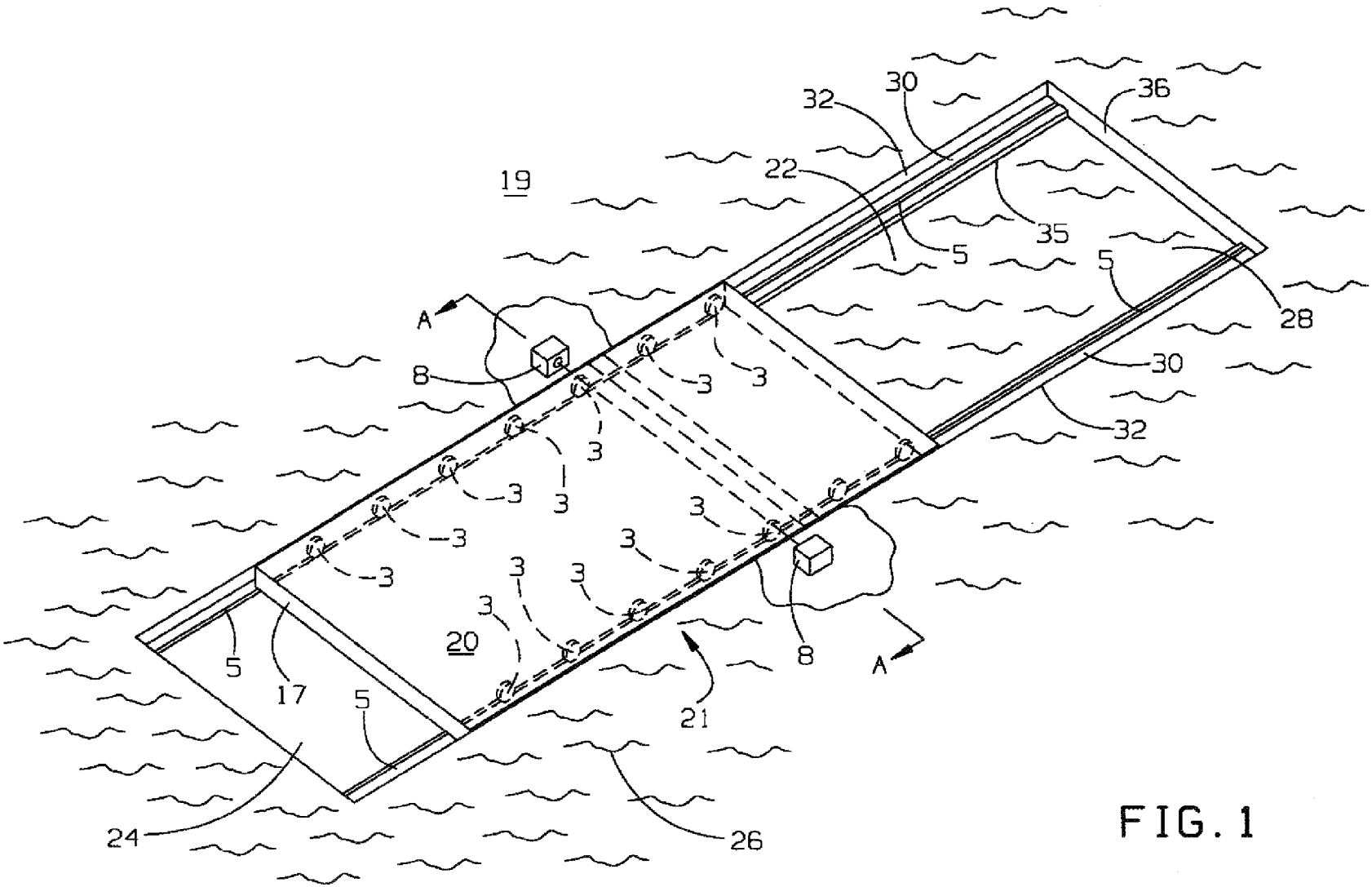
FIG. 1 is a partial cut-away perspective view of a swimming pool construction with a movable deck in accordance with an exemplary embodiment of the present invention.

FIG. 1 is a partial cut-away perspective view of a swimming pool construction 19 that combines a swimming pool 22 with a movable deck construction 21 in accordance with an exemplary embodiment of the present invention. The swimming pool construction 19 allows full utilization of the pool surface for dining, sport and other activities when the pool 22 is not used for swimming. It also protects the pool 22 from dust and can prevent children from using the pool 22 without adult supervision or life guard presence.

The deck construction 21 includes a movable deck 17, tracks 5 and drive sources 8 mounted to surrounding structure for moving the deck 17 horizontally along the tracks 5. In operation, the deck 17 is moved in either direction along the tracks 5 to selectively cover and uncover the pool 22.

The tracks 5 are located on opposite sides of the pool 22 and depression 24.

The deck 17 includes a single, rigid unitary platform 20 and wheels 3 rotatably mounted to the bottom side of the platform 20. The wheels 3 roll along the tracks 5 to allow horizontal movement of the platform 20 over the pool 22 and within the depression 24. The length of the deck 17 is somewhat greater than the length of the pool 17 so that the drive sources 8 remain continuously engaged with the deck 17. The deck 17 is structurally designed to support loads normally supported by equivalent conventional flooring areas in buildings and residences.

The drive sources 8 are mounted in driving engagement with opposite sides of the deck 17. The sources 8 include rotary power sources, such electric motors combined with gear operators. Each of the sources 8 also includes one or more drive mechanisms 11 (see FIGS. 3-4), such as gears, worms, frictional wheels, or the like, rotatably engaging the deck 17 to cause the deck 17 to move in either direction along the tracks 5. In the example embodiment, the drive sources 8 are mounted below level of the surrounding area 26 and concealed by covers. In this arrangement, the sources 8 do not present a hazard to pool users and their concealment improves the ascetics of the pool area.

The drive sources 8 include a common control interface that synchronizes operation of the sources 8. The control interface further includes one or more switches permitting a user to selectively activate the drives 8 and to select the direction of deck travel. The switches can be located away from the pool construction 19 and wired to the sources 8 if so desired. Also, an optional wireless remote control feature can be included to allow a user to remotely control movement of the deck 17.

The depression 24 extends from one end of the pool 22 and is formed to create a lowered area in the surface area 26 surrounding the pool construction 19. The purpose of the depression 24 is to keep the deck 17 level with the surrounding surface 26 when it is moved into the depression 24 to uncover the pool 22. The depth of the depression 24 corresponds to the height of the movable deck 17 and is selected so that the top of the deck 17 is substantially level with the surrounding surface 26. The length of the depression 24 is preferably equal to or greater than the length of the deck 17 so that the deck 17 can be moved to fully uncover the pool 22. The depression's width is slightly greater than that of the deck 17 so that no substantial gaps occur between the side of the deck 17 and surrounding surface area 26.

When the deck 17 is moved to cover the pool 22, one or more insert platforms (not shown) can be placed in the depression 24 to fill it so that the depression area is level with the surrounding surface area 26. The inserts are substantially the same height as the deck 17 and provide a level surface. The inserts allow the depression area to be fully utilized without presenting a hazard. They are particularly useful when the pool 22 is not used for an extended period of time, such as being closed for the winter season.

The pool 22 includes support ledges 30 formed along opposite sides 32 above pool side walls 35 and preferably above the pool water 28, terminating at the pool end walls 36. The ledges 30 are level with the bottom of the depression 24. The ledges 30 are designed to support the weight of the deck 17 and any deck load, and to securely mount the tracks 5. The width of the ledges 30 is generally a matter of design choice, but should be sufficient to adequately support the tracks 5, deck 17 and load weight. The pool 22 can be of any suitable design or shape, and can be made of any suitable construction materials, including those typically used in conventional pool constructions.

Figure 2:
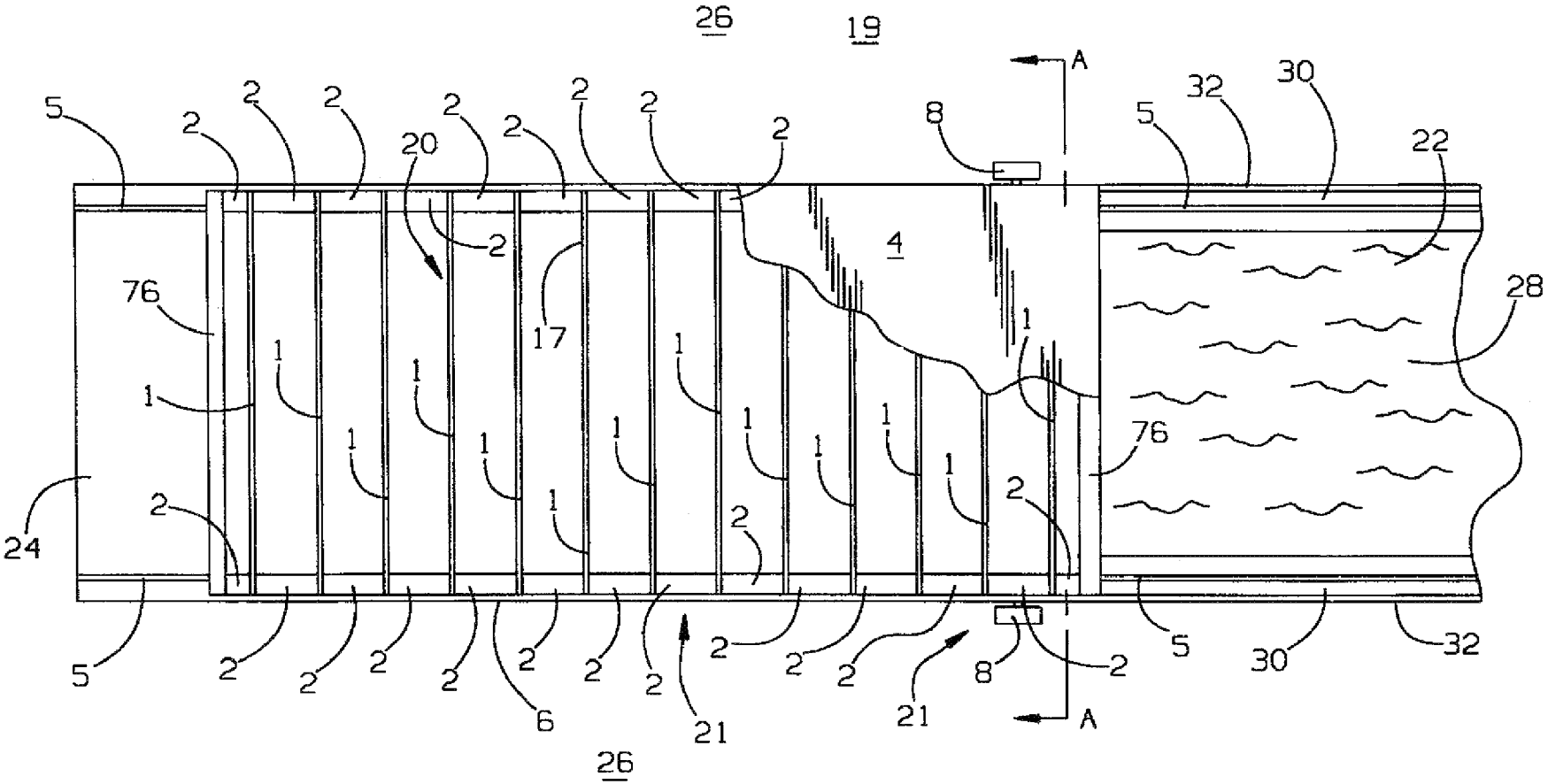
FIG. 2 is a top down cut-away view of the swimming pool construction shown in FIG. 1.

FIG. 2 is a top down, cut-away view of the swimming pool construction 19 showing the frame of the deck 17. The deck platform 20 is constructed using corrosion-resistant steel framing beams and components 1, 2, 6, 76 and other metal components especially coated for protection against high humidity level around water pools. Although steel is preferably used, any other suitable structural materials can be used in the deck construction 21.

The deck platform frame includes plural transverse steel beams 1 spanning across between the two opposite sides 32 of the pool 22. The beams 1 are welded at each end to longitudinal continuous steel members 6 spanning along structural sides 32 of the pool 22. A deck flooring layer 4 spans over the transverse steel beams 1, covering the deck frame. The flooring layer 4 can be a layer of transparent tempered glass. The glass provides a significant ascetic enhancement because it allows people to use the deck 17 for recreational purposes, while at the same time enjoying the lights and water of swimming pool scenery beneath the deck 17.

Transverse support members 76 span the ends of the deck 17 and edge support members 2 are attached to longitudinal members 6 between the transverse beams 1 to support the edges of the flooring layer 4.

Figure 3:
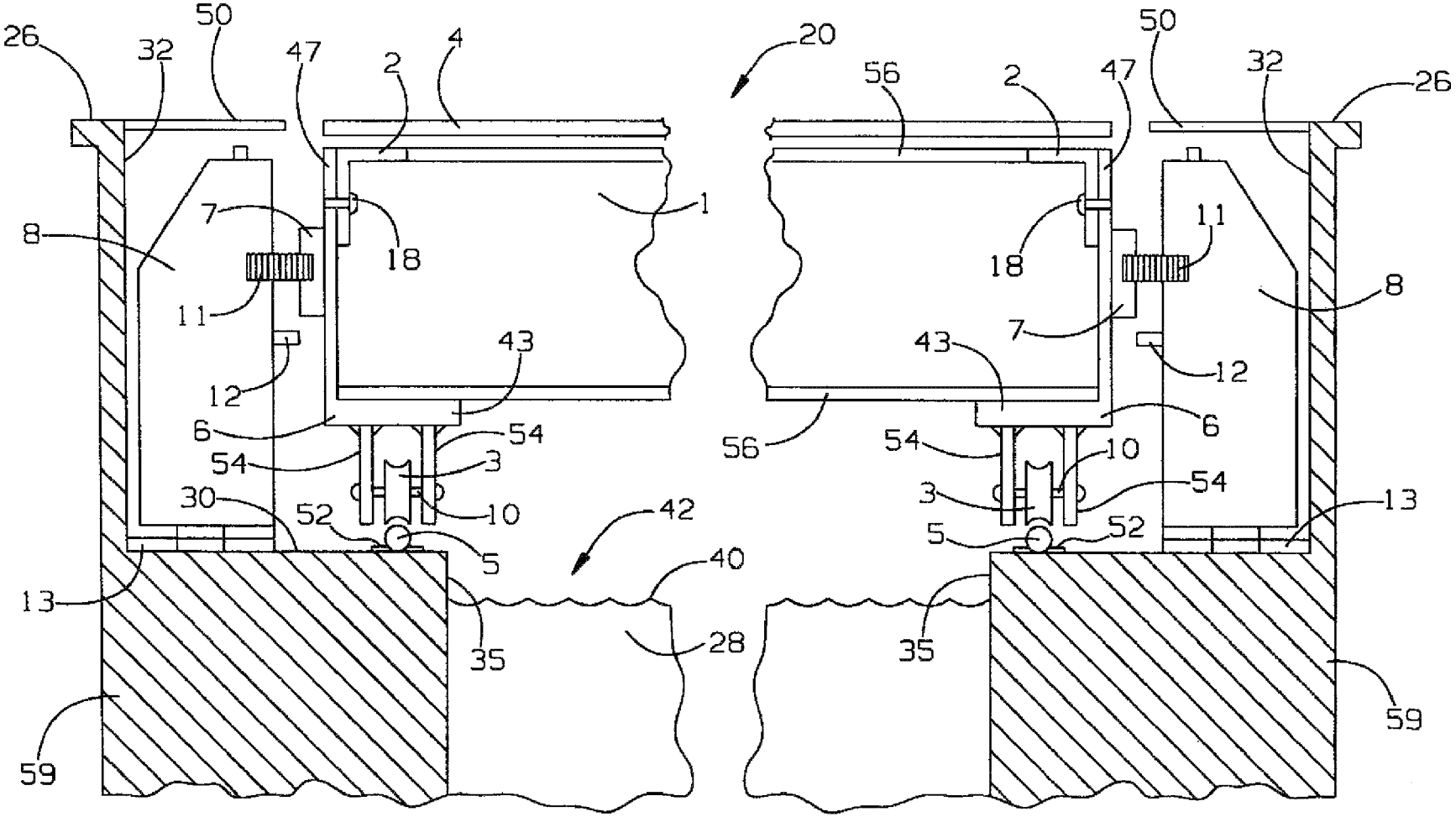
FIG. 3 is a cross-sectional view of the swimming pool construction along section A-A shown in FIGS. 1-2.

FIG. 3 is a cross-sectional view of the swimming pool construction 19 along section A-A shown in FIGS. 1-2. The entire pool construction 19 is supported by a surrounding structural substrate 59, such as concrete or any other suitable building material. Components of the deck construction 21 are all positioned above the surface level 40 of the water 28 contained in the open space 42 of the pool 22.

The tracks 5 are preferably corrosion-resistant cylindrical bars, such as a coated steel or stainless steel, welded to longitudinal steel plates 52 that are fixed to the ledges 30. The plates 52 are coated or made of stainless steel to resist corrosion.

Steel brackets 54 are welded to the bottoms 43 of the longitudinal continuous steel members 6 to support the wheels 3. The wheels 3 can be special Teflon® wheels, or alternatively, they can be made of hard plastic with sealed ball bearings that rotate about axles 10, which are attached to the brackets 54. The concave circumference of the wheels 3 allows them to run on and be guided by the track bars 5.

The longitudinal members 6 are L-shaped beams, each having a side wall 47 and bottom 43. Longitudinal racks 7 are fixed on and extend the length of member side wall 47. The racks 7 include teeth for engaging pinion gears 11 that act as the drive mechanisms of the sources 8. This rack-and-pinion drive arrangement represents a significant advance over prior art moving deck designs because it effectively conceals the racks and pinions from users. With this inventive arrangement, a pool user attempting to exit the pool over a side wall can not be injured by exposed rack teeth running along the edge of the pool. In addition, the rack and pinions are significantly less exposed to pool water, and thus, they are considerably less susceptible to corrosion damage.

Mounting plates 13 are used to fix the drive sources 8 to the ledges 30. The drives 8 include limit switches 12 that limit that travel of the deck 17. The drives 8 can be user activated to begin and continue movement of the deck 17 until the switches 12 are tripped, which automatically terminates deck movement at a desired position. The switches 12 are tripped when they make contact with corresponding tangs (not shown) extending away from the outside of the member side wall 47. The tangs are positioned on the sidewalls 47 so that the switches deactivate the drives 8 when the deck reaches either end of it travel: either in the fully covered position or fully uncovered position.

Although two switches 12 are shown, any other suitable number of limit switches, including a single switch, can be used.

Covers 50, shown in their closed position, are provided to conceal the drives 8. The covers 50 can be opened or removed to gain access to the drives 8.

Transverse beams 1 can have any suitable structural shape, such as tube sections, back-to-back channels, I-beams or the like. Preferably, the transverse beams 1 are corrosion resistant I-beams having upper and lower flanges 56.

Edge support members 2 are L-shaped beams that are attached to the longitudinal beam sidewalls 47 so that the upper flanges of the members 2 are substantially even with the top flanges 56 of the I-beams 1. As shown, the members 2 are attached using bolts 18 or welds. However, other suitable techniques for attachment, such as riveting, may be used.

Figure 4:
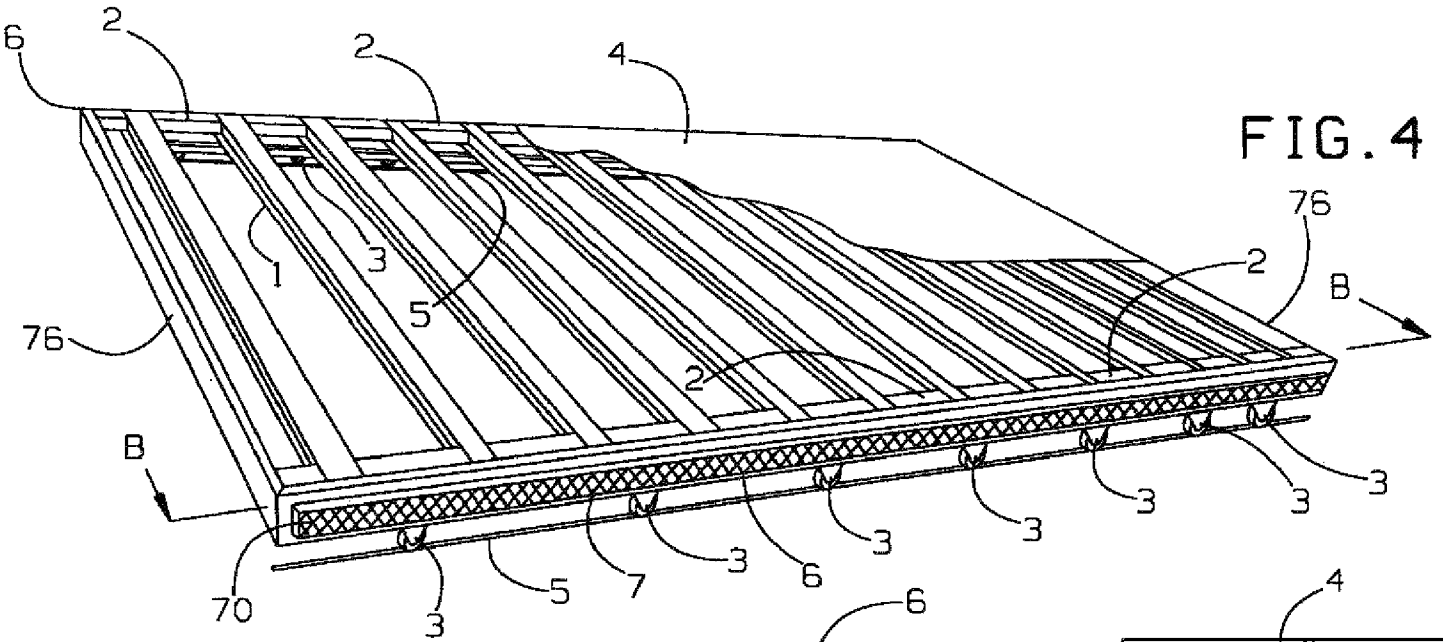
FIG. 4 is a first cut-away perspective view of the movable deck cover shown in FIG. 1.

FIG. 4 is a first cut-way perspective view of the movable deck 17 shown in FIG. 1. This view shows the teeth 70 of one of the racks 7.

Figure 5:
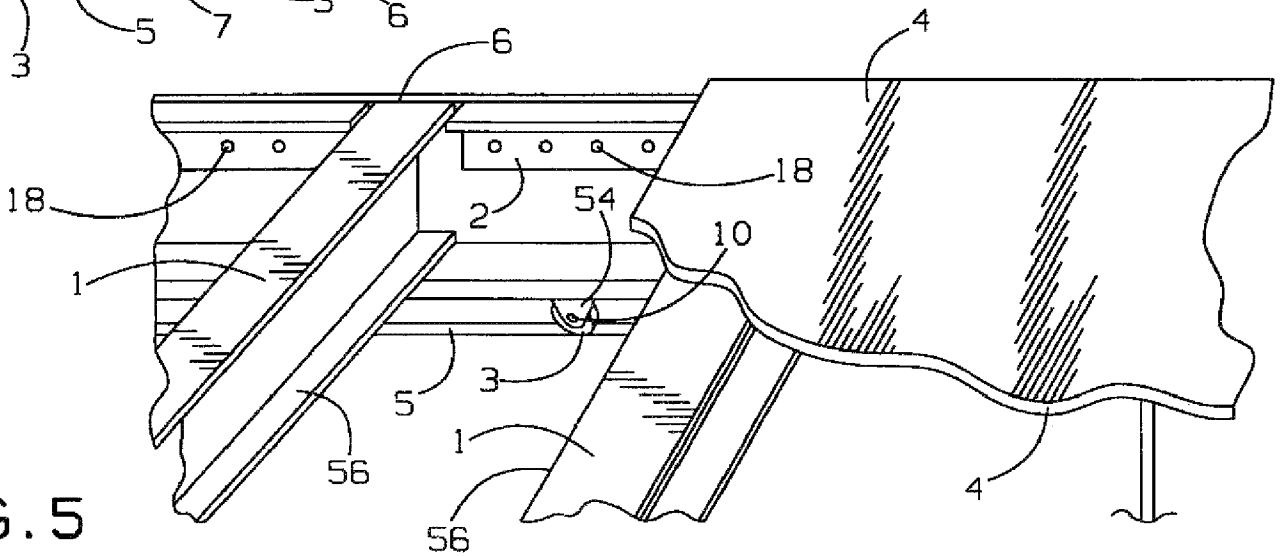
FIG. 5 is a second cut-away perspective view of the movable deck cover shown in FIG. 1.

FIG. 5 is a second cut-away perspective view of the movable deck 17 shown in FIG. 1.

Figure 6:
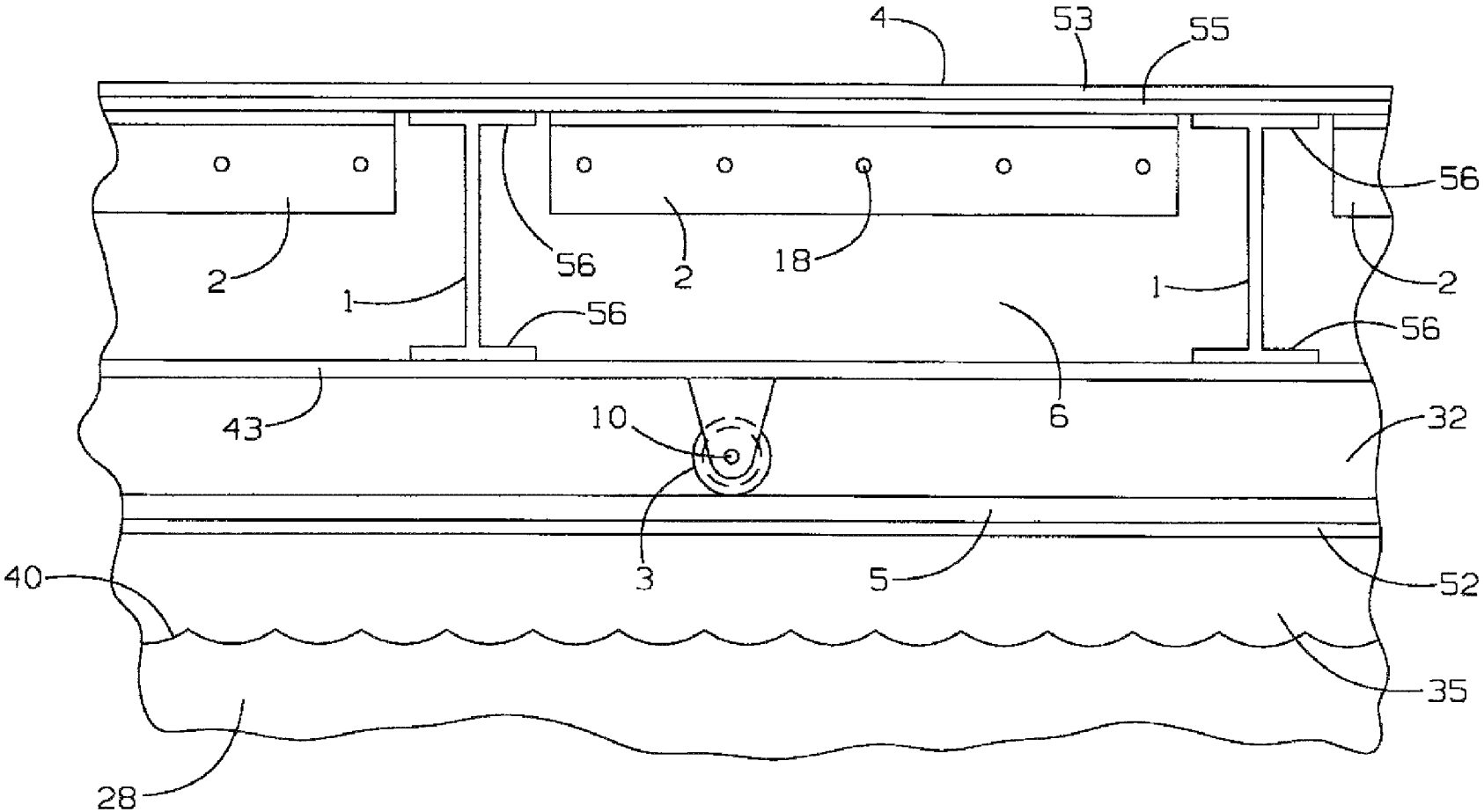
FIG. 6 is a cross-sectional view of the movable deck cover along section B-B shown in FIG. 4.

FIG. 6 is a cross-sectional view of the movable deck 17 along section B-B shown in FIG. 4. This view illustrates an example of the flooring layer 4 that includes multiple layers 53, 54 of flooring material to increase support.

Figure 7:
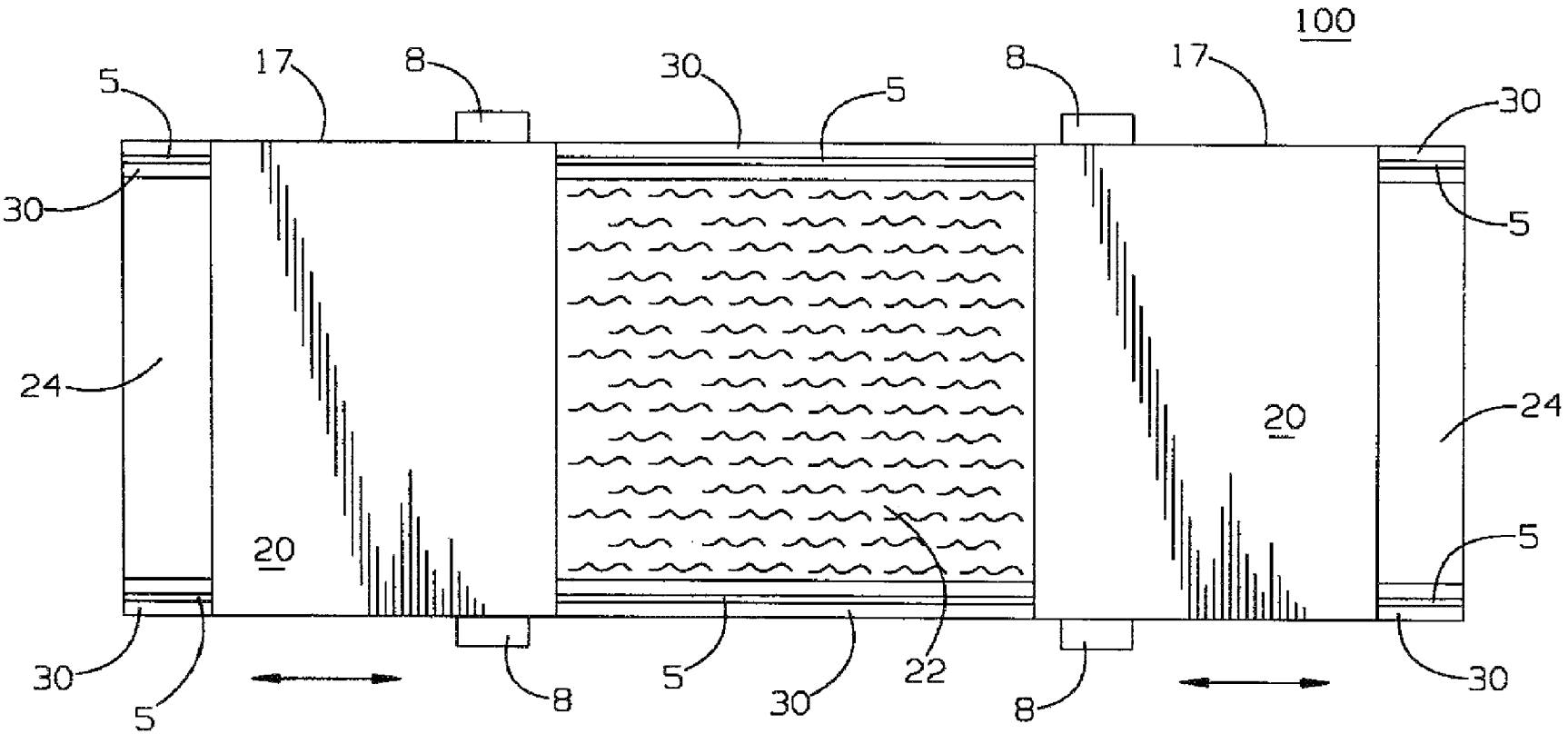
FIG. 7 is a top plan view of a swimming pool construction in accordance with another exemplary embodiment of the present invention.

FIG. 7 is a top plan view of a swimming pool construction 100 in accordance with another exemplary embodiment of the present invention. In this embodiment, the deck construction includes two movable decks 17 that slide in opposition directions to cover and uncover the swimming pool 22. Two pairs of drive sources 8 work together to move the decks 17 along the tracks 5. Two depressions 24 are formed at either end of the swimming pool 22 and the ledges 30 and tracks 5 extend beyond both ends of the pool 22 into the depressions 24. When closed, the decks 17 meet over the middle of the pool 22 to form a complete cover. When open, the decks 17 move into opposite depressions 24. In all other respects, the swimming pool construction 100 includes the same structures and features of the swimming pool construction 19 described in connection with FIGS. 1-6.

Figure 8:
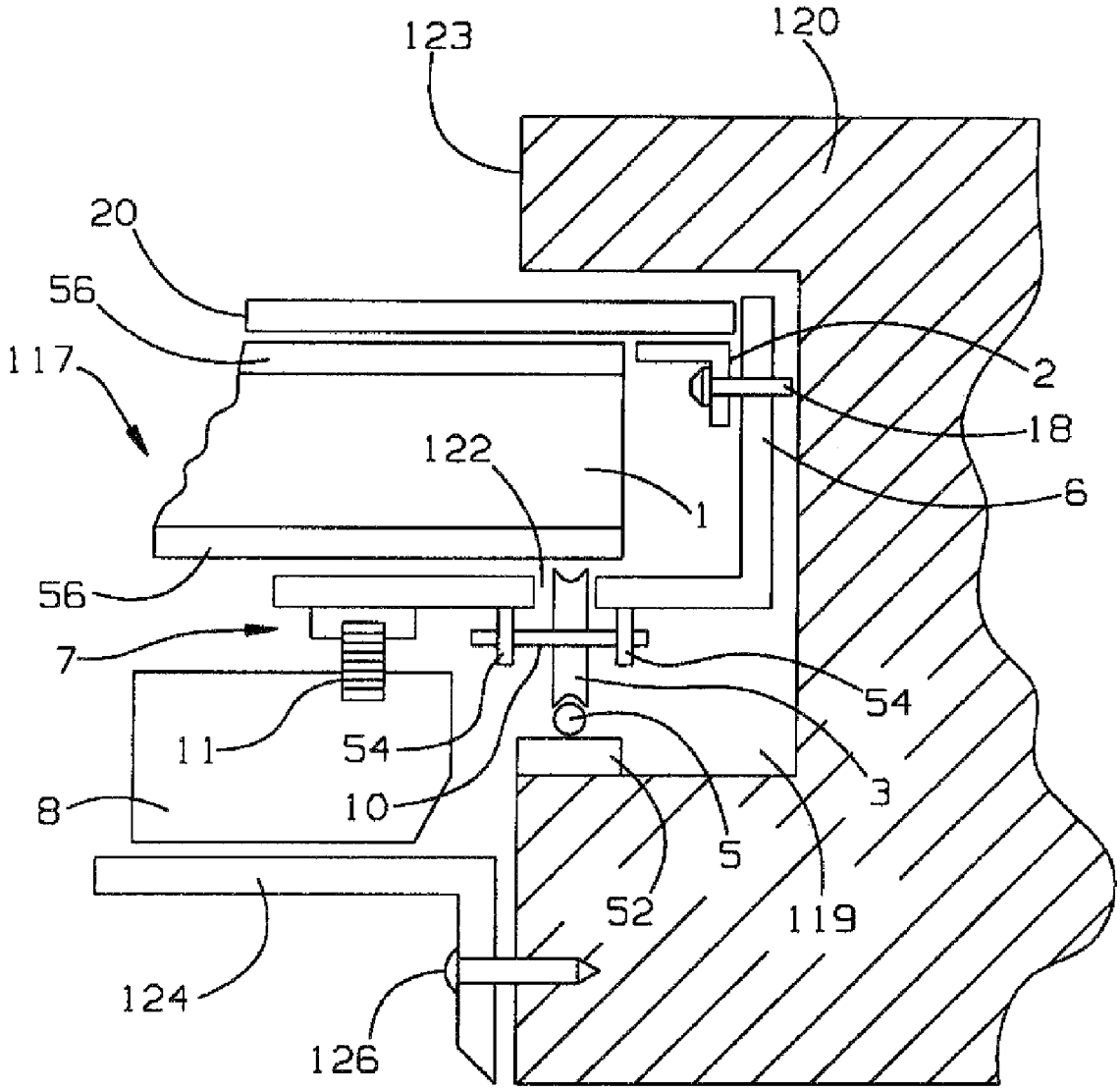
FIG. 8 is a cross-sectional view of an alternative deck construction useable in areas of limited space, in accordance with a further exemplary embodiment of the present invention.

FIG. 8 is a cross-sectional view of an alternative deck construction 200 useable in areas of limited space, in accordance with a further exemplary embodiment of the present invention. The deck construction 200 is particularly useful for moving balconies or canopies extending from ceilings having limited space. The deck construction 200 can be used as balcony/canopy floor of a restaurant on sea shore or a balcony/canopy of a skyscraper apartment or restaurant. The deck construction 200 includes a moving deck 117 that is designed to slide under, into or over a floor of a building in a compact manner.

The deck construction 200 shares many of the same features and structures included in the swimming pool constructions 19, 100 described in connection with FIGS. 1-7. However, the deck construction 200 includes several additional features to make it more compact.

The first additional feature includes support ledges 119 integrally formed in an existing building floor slab 120 on opposite sides of the deck 117. Alternatively, the support ledges 119 can be provided by including an I-beam in the slab 120, where the upper and lower flanges of the I-beam provide the upper ledge 123 and support ledge 119, respectively.

The second additional feature is under-mounted drive sources 8. In this configuration, the drive sources 8 are mounted on a ledge 124 underneath the deck 117 and the racks 7 are mounted to the bottom of the platform longitudinal member 6. The bottom base of the member 6 can be extended to support the rack 7. The ledge 124 is fastened to the building slab 120 using a lag bolt or any other suitable fastening means.

The third additional feature is low profile wheels mounted on the deck 117. To permit low-profile wheels, openings 122 are formed in the base of member 6 so that a portion of the wheels 3 extend into the member base. The wheel brackets 54 can thus be shorted to reduce the overall profile height of the movable deck 117. The wheels 3 can be placed between transverse beams 1 so that the beams 1 do not interfere with the rotation of the wheels 3 when the low-profile mount is used.

The preceding detailed description has illustrated the principles of the invention using specific implementations of a movable pool deck and a movable balcony/canopy. However, the invention is not limited to these particular implementations. For example, the inventive principles disclosed herein can be implemented in other types of structures, such as moving covers on ship decks, containers or underground shelters, or other types of moving floors included in other man-made structures, without departing from the principles of the invention.

Therefore, while one or more specific embodiments of the invention have been described above, it will be apparent to those of ordinary skill in the art that many more embodiments are possible that are within the scope of this invention. Further, the foregoing detailed description and drawings are considered as illustrative only of the principles of the invention. Since other modifications and changes may be or become apparent to those skilled in the art, the invention is not limited the exact construction and operation shown and described herein, and accordingly, all suitable modifications and equivalents are deemed to fall within the scope of the invention.

What is claimed is:

1. A deck construction, comprising:

a rigid, unitary platform;

a plurality of wheels rotatably mounted to the bottom side of the platform in regular spacing along opposing, lateral ends of the platform;

a pair of tracks, each mounted on a respective ledge, the ledges being formed on opposite sides of an open space located beneath the platform, the wheels rollably engaging the tracks to allow horizontal movement of the platform over the open space;

a plurality of racks, each rack mounted one of the opposing, lateral ends of the platform;

a plurality of drive mechanisms mounted on the opposite sides of the open space along the ledges, below the level of the surrounding surface area, in driving engagement with the racks; and a plurality of sources of rotary power located on the opposite sides of the open space and operatively connected to the drive mechanisms, for rotating the drive mechanisms to cause the platform to move horizontally in either direction along the tracks.

2. The deck construction of claim 1, wherein in the open space is a swimming pool.

3. The deck construction of claim 1, wherein the drive mechanism includes a drive gear rotatably mounted along a substantially vertical axis in driving engagement with outwardly directed teeth included on the rack.

4. The deck construction of claim 1, wherein the platform includes:

a plurality of longitudinal support members spanning along the opposite sides of the open space; and a plurality of transverse beams attached to the longitudinal support members and spanning across the open space between the opposite sides.

5. The deck construction of claim 4, wherein the platform further comprises a tempered glass layer spanning over the transverse beams.

6. The deck construction of claim 4, wherein the platform includes a plurality of layers of materials spanning over the transverse beams.

7. The deck construction of claim 1, further comprising a plurality of longitudinal support plates fastened to the opposite sides of the open space, wherein the tracks are attached to the plates.

8. The deck construction of claim 1, wherein the tracks are round bars engaging generally concave contact surfaces formed on the wheels.

9. The deck construction of claim 1, further comprising:

a control interface that synchronizes operation of the sources of rotary power, the control interface including one or more switches permitting a user to selectively activate the sources and to select the direction of platform travel.

10. The deck construction of claim 1, wherein the drive mechanisms include limit switches for limiting travel of the platform, and the platform includes a plurality of tangs extending away from the opposing, lateral ends of the platform to trip the switches to deactivate the drive mechanisms when the platform reaches either end of its travel.

11. A swimming pool construction, comprising:

a swimming pool having side and end walls defining an open-top chamber extending downwardly below a surrounding surface area, for holding a quantity of water;

support ledges formed along opposite side walls of the swimming pool above the water line of the pool and below the surrounding surface area;

a lowered area formed in the surrounding surface area and extending from an end wall of the swimming pool, the lowered area configured to receive a rigid, unitary platform as it is removed from over the pool; and a deck construction for selectively covering the swimming pool, comprising:

the rigid, unitary platform;

a plurality of wheels rotatably mounted to the bottom side of the platform above the ledges;

a plurality of tracks mounted on the ledges on opposite sides of the pool and extending into the lowered area, for supporting the platform, the wheels rollably engaging the tracks to allow horizontal movement of the platform into and out of the lowered area;

a plurality of racks, each rack mounted on an opposing lateral end of the platform;

a plurality of drive mechanisms mounted on the opposite sides of the pool along the ledges, below the level of the surrounding surface area at least in part, in driving engagement with the racks; and a plurality of sources of rotary power located on the opposite sides of the pool, below the level of the surrounding surface area at least in part, and operatively connected to the drive mechanisms, for rotating the drive mechanisms to cause the platform to move horizontally in either direction along the tracks.

12. The swimming pool construction of claim 11, wherein the platform is sized and shaped to completely cover the surface of the pool when the platform is in a closed position.

13. The swimming pool construction of claim 11, wherein the deck construction is configured so that the top of the platform is substantially level with the surrounding surface area.

14. The swimming pool construction of claim 11, wherein the platform includes:

a plurality of longitudinal support members spanning along the ledges on opposite sides of the pool; and a plurality of transverse beams attached to the longitudinal support members and spanning across the pool between the opposite sides.

15. The swimming pool construction of claim 14, wherein the longitudinal support members are L-beams.

16. The swimming pool construction of claim 14, wherein the transverse beams are I-beams.

17. The swimming pool construction of claim 14, wherein the platform further comprises a tempered glass layer spanning over the transverse beams.

18. The swimming pool construction of claim 17, wherein the platform further comprises supports extending along the longitudinal support member between the transverse beams to support the edges of the tempered glass layer.

19. The swimming pool construction of claim 11, further comprising:

a control interface that synchronizes operation of the sources of rotary power, the control interface including one or more switches permitting a user to selectively activate the sources and to select the direction of platform travel.

20. The swimming construction of claim 11, wherein the drive mechanisms include limit switches for limiting travel of the platform, and the platform includes a plurality of tangs extending away from the opposing, lateral ends of the platform to trip the switches to deactivate the drive mechanisms when the platform reaches either end of its travel.

* * * * *